US005438937A

United States Patent [19]

Ball et al.

[11] Patent Number: 5,438,937

[45] Date of Patent: Aug. 8, 1995

[54] MOBILE TABLE SYSTEM

[75] Inventors: Douglas C. Ball, Senneville, Canada; Lon D. Scheerhorn, Byran Center, Mich.

[73] Assignee: Steelcase Inc., Grand Rapids, Mich.

[21] Appl. No.: 74,073

[22] Filed: Jun. 8, 1993

[51] Int. Cl.[6] ..... A47B 57/00

[52] U.S. Cl. ..... 108/64; 403/329

[58] Field of Search ..... 108/64, 66, 50; 312/249.8, 107, 201; 403/329, 326

[56] References Cited

U.S. PATENT DOCUMENTS

| | | |
|---|---|---|
| D. 56,541 | 11/1920 | Sailer . |
| 79,127 | 6/1968 | Johnson . |
| D. 148,776 | 2/1948 | Fay . |
| D. 186,881 | 12/1959 | Ogg . |
| D. 188,418 | 7/1960 | Salveson . |
| D. 233,088 | 10/1974 | Skarky . |
| D. 251,946 | 5/1979 | Schneider . |
| D. 252,432 | 7/1979 | Brelsford . |
| D. 268,715 | 4/1983 | Curry . |
| D. 279,846 | 7/1985 | Esslinger . |
| D. 282,096 | 1/1986 | Levand . |
| D. 282,775 | 2/1986 | Floyd, Sr. . |
| D. 288,756 | 3/1987 | McCarty . |
| D. 291,851 | 9/1987 | Salvato . |
| D. 295,004 | 4/1988 | Schulz et al. . |
| D. 320,709 | 10/1991 | Lotsch et al. . |
| D. 331,164 | 11/1992 | Deimen et al. . |
| D. 332,535 | 1/1993 | Hosoe . |
| D. 332,536 | 1/1993 | Hosoe . |
| D. 332,537 | 1/1993 | Hosoe . |
| D. 332,538 | 1/1993 | Hosoe . |
| D. 332,885 | 2/1993 | Miller . |

(List continued on next page.)

FOREIGN PATENT DOCUMENTS 53-26987 3/1978 Japan .

OTHER PUBLICATIONS

"Technics Tropics" Bio-Tables and Office Space designed by Isao Hosoe, Progressive Architecture (1 page) dated Nov. 1989.

"Metric Borers" by Selby Hardware Co. (1 page) date unknown.

"Draw Latches" by Eberhard Manufacturing Co. of Cleveland, Ohio (1 page) dated 1988.

"Furniture Hardware" by National Lock Hardware of Rockford, Illinois (1 page.) date unknown.

"Ceramic Knobs" by Selby Hardware Co. (1 page) date unknown.

"Butt Hinges" by Selby Furniture Hardware Co. (1 page) date unknown.

"Wiremold Electric Ideas" by Electrical Construction & Maintenance, McGraw-Hill (2 pages) dated Feb. 1971.

"Wiremold Electric Ideas" by Electrical Construction & Maintenance, McGraw-Hill (2 pages) dated Nov. 1971.

*Primary Examiner*—José V. Chen

*Attorney, Agent, or Firm*—Price, Heneveld, Cooper, DeWitt & Litton

[57] ABSTRACT

A mobile table system is provided in which multiple tables can be juxtaposed in many different configurations to facilitate a wide variety of both group and individual activities. Each table has a top with oppositely oriented side edges shaped to abut flush with the side edges of like tables, an outer marginal edge configured to accommodate a user thereby, and an inner marginal edge with a generally concave shape which defines a central space when aligned with the inner marginal edges of like tables. Each table includes legs to support the same freestanding on a floor surface. A first one of the legs depends from the top adjacent the outer marginal edge thereof and has a foot at the lower end thereof, and a second one of the leg depends from the top adjacent the inner marginal edge thereof and has a roller at the lower end thereof, so as to permit manual translation of the tables across the floor surface in a wheelbarrow fashion. A latch arrangement may be provided to detachably interconnect like tables in a manner which enables the same to be readily pulled apart.

44 Claims, 8 Drawing Sheets

U.S. PATENT DOCUMENTS

D. 333,053 2/1993 Hosoe .
691,532 1/1902 Clark .
774,046 11/1904 Davis .
1,004,550 10/1911 Bertke .
2,404,182 7/1946 Kump, Jr. .
2,596,663 5/1952 Duffy .
2,694,614 11/1954 Dent .
2,836,475 5/1958 Sapp .
2,857,223 10/1958 Furey .
2,972,506 2/1961 Haag .
3,053,598 9/1962 Cheslow .
3,068,821 12/1962 Hermanns .
3,181,484 5/1965 Keepler .
3,194,361 7/1965 Thurman .
3,202,117 8/1965 Zimmerman .
3,259,432 7/1966 Jackson .
3,267,881 8/1966 Saggione .
3,313,510 4/1969 Mudano .
3,342,147 9/1967 Shettles .
3,367,291 2/1968 Evans .
3,421,459 1/1969 Sherwood .
3,437,390 4/1969 Evans .
3,533,362 10/1970 Thompson .
3,683,101 8/1972 Liberman .
3,703,870 11/1972 Walton .
3,741,130 6/1973 Workman et al. .
3,741,852 6/1973 Keener .
3,915,100 10/1975 Sullivan ..... 108/64
3,920,299 11/1975 Propst et al. .
4,066,023 1/1978 Hughes .
4,106,828 8/1978 Belokin, Jr. .
4,150,630 4/1979 Pokorny et al. .
4,158,335 6/1979 Belcastro .
4,165,908 8/1979 Cooper et al. .
4,266,882 5/1981 Wilhelmi et al. .
4,285,281 8/1981 Frick .
4,353,411 10/1982 Harter et al. .
4,365,561 12/1982 Tellier et al. .
4,408,543 10/1983 Griffin .
4,424,604 1/1984 Dupuis .
4,433,884 2/1984 Edwards et al. ..... 312/107 X
4,559,877 12/1985 Waibel .
4,591,289 5/1986 Vickers et al. .
4,665,836 5/1987 Burr .
4,693,187 9/1987 Bisbing .
4,706,572 11/1987 Priesemuth ..... 108/66 X
4,732,088 3/1988 Koechlin et al. .
4,735,151 4/1988 Bisbing .
4,740,033 4/1988 Lee ..... 108/64 X
4,863,223 9/1989 Weissenbach et al. .
4,884,513 12/1989 Newhouse et al. .
4,915,034 4/1990 Grabe et al. .
4,922,835 5/1990 Van Vliet et al. .
4,936,228 6/1990 Capo-Bianco ..... 108/64
4,974,284 12/1990 Campbell .
4,974,915 12/1990 Bussard ..... 108/52 X
4,978,168 12/1990 Piretti .
4,984,926 1/1991 Harley .
5,016,405 5/1991 Lee .
5,037,164 8/1991 Weissenbach et al. .
5,065,832 11/1991 Mark .
5,083,512 1/1992 Newhouse et al. .
5,087,106 2/1992 Betts ..... 403/329 X
5,144,888 9/1992 Heine et al. .
5,154,126 10/1992 Newhouse et al. .
5,182,996 2/1993 Gutgsell .
5,255,966 10/1993 Newhouse et al. ..... 108/64 X

MOBILE TABLE SYSTEM

CROSS-REFERENCES TO RELATED APPLICATIONS

The present application is related to commonly assigned, co-pending United States design patent application Ser. No. 009,198, filed Jun. 8, 1993, entitled MOBILE TABLE DESIGN, which is hereby incorporated by reference.

BACKGROUND OF THE INVENTION

The present invention relates to furnishings, and in particular to a mobile table system.

Modular table systems are generally well known in the art, and typically comprise multiple like tables which can be juxtaposed to form an enlarged worksurface, such as for office conference areas, classrooms, cafeterias, restaurants, and other similar environments. Such prior art tables are normally somewhat heavy and awkward to reconfigure, so that they usually require more than one person to handle effectively. Also, the table shapes heretofore available in such systems are rather limited, and are therefore not readily adaptable for a wide variety of different configurations and/or uses. The increased popularity of team problem solving and collaborative work styles creates the need for worksurfaces that can move and change as quickly as today's workers, and address a broad range of communication styles and work process needs.

Another drawback associated with the prior modular table systems is that the adjacent tables tend to separate inadvertently when bumped or jostled. As a result, unsightly gaps develop between adjacent tables, which must be covered with a table cloth or the like. Although some types of table constructions are provided with a latch mechanism to avoid this problem, they tend to be cumbersome to operate, with some even requiring manipulation from underneath the table. Also, most prior table latches require that adjacent tables be converged in a square and aligned fashions or the opposite latch members will not engage properly. When multiple tables are arranged in a closed marginal configuration, such as a circle, square, rectangle, etc., the last table to be installed in the group must normally be inserted at an angle to the next adjacent tables, which renders the latching operation more difficult.

SUMMARY OF THE INVENTION

One aspect of the present invention is to provide a mobile table, comprising a top having a pair of oppositely oriented side edges configured to abut generally flush with similar side edges of adjacent like mobile tables to create an enlarged substantially continuous worksurface, an outer marginal edge configured to accommodate a user thereby, and an inner marginal edge with a generally concave shape which defines a central space when aligned with similar inner marginal edges of adjacent like mobile tables. The table includes a plurality of legs connected with the top and depending therefrom to support the mobile table on a floor surface in a freestanding fashion. A first one of the legs has an upper end thereof connected with the top at a location disposed adjacent to the outer marginal edge, and a lower end thereof with a foot to abut the floor surface. A second one of the legs has an upper end thereof connected with the top at a location disposed adjacent the inner marginal edge, and a lower end thereof with a roller to permit manual translation of the mobile table across the floor surface in a wheelbarrow fashion.

Another aspect of the present invention is a modular table system comprising a plurality of individual modular tables, each including a top having at least one side edge thereof configured to abut generally flush with a similar side edge of an adjacent one of the modular tables to create an enlarged substantially continuous worksurface, and at least one leg connected with the top and depending therefrom to support the modular tables on a floor surface in a freestanding fashion. A male latch member is mounted on a first one of the modular tables, and includes a resilient arm configured to protrude outwardly of the side edge of the first table. The male latch member includes an upwardly protruding barb portion disposed adjacent a free end of the arm, with a beveled outer edge. A female latch member is mounted on a second one of the modular tables, and includes a catch edge shaped to engage the barb portion of the male latch member, and is positioned to selectively retain the side edges of the first and second tables closely together when the same are positioned in an adjacent and aligned condition. The female latch member includes a marginal edge portion, which is disposed outwardly of the catch edge adjacent the side edge of the second table, and is beveled to wedgingly mate with the beveled outer edge of the male latch member. The marginal edge extends uninterrupted between opposite sides of the catch edge, whereby the barb portion of the male latch member is abuttingly deflected over the beveled marginal edge of the female latch member and snaps into place against the catch edge, even when the side edges of the first and second tables are manually converged along a line of motion which is not substantially perpendicular to the side edges.

Yet, another aspect of the present invention is a modular table comprising a top having at least one side edge thereof configured to abut generally flush with a similar side edge of an adjacent one of the modular tables to create an enlarged substantially continuous worksurface, and at least one leg connected with the top and depending therefrom to support the modular table on a floor surface in a freestanding fashion. A male latch member is mounted on the top adjacent one end of the side edge, and includes a resilient arm configured to protrude outwardly from the side edge, with an upwardly protruding barb having a beveled outer edge. A female latch member is mounted on the top adjacent the opposite end of the side edge, and includes a catch edge shaped to engage the barb portion of an adjacent male latch member, and positioned to selectively retain the side edges of adjacent modular tables closely together when the same are positioned in an adjacent and aligned condition.

The principle objects of the present invention are to provide a modular table and related system which is mobile, so that it can be easily reconfigured by a single user to facilitate a wide variety of both group and individual activities. A plurality of different table top shapes provide extensive flexibility in group configurations to meet the ever-changing needs of the users, particularly in shared spaces. Each table is quite sturdy and stable, yet it can be easily translated across a floor surface in a wheelbarrow fashion by a single user of even modest strength. Each table is specially configured to make aligning adjacent tables an immediately intuitive process. Special latches on the tables help prevent adjacent tables from inadvertently separating, yet permit them to be manually pulled apart when desired, without latch manipulation. The latches are retractable to permit each table to be used in a stand-alone condition, and will engage even when adjacent tables are converged along an angle. The table tops may be provided with a cutout at their interior corners, so that when the tables are arranged in a closed plan shape, a center space is created in which a utility post may be received to provide power, communications, data, and the like, to the table grouping. Preferably, the inner and outer marginal edges of the tops are similarly configured, so that they match when adjacent tables are oriented in any of several different configurations. The tables are very flexible and adaptable, and can be easily and quickly assembled to match the specific tasks and space at hand. Furthermore, the tables are efficient in use, ecenomical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
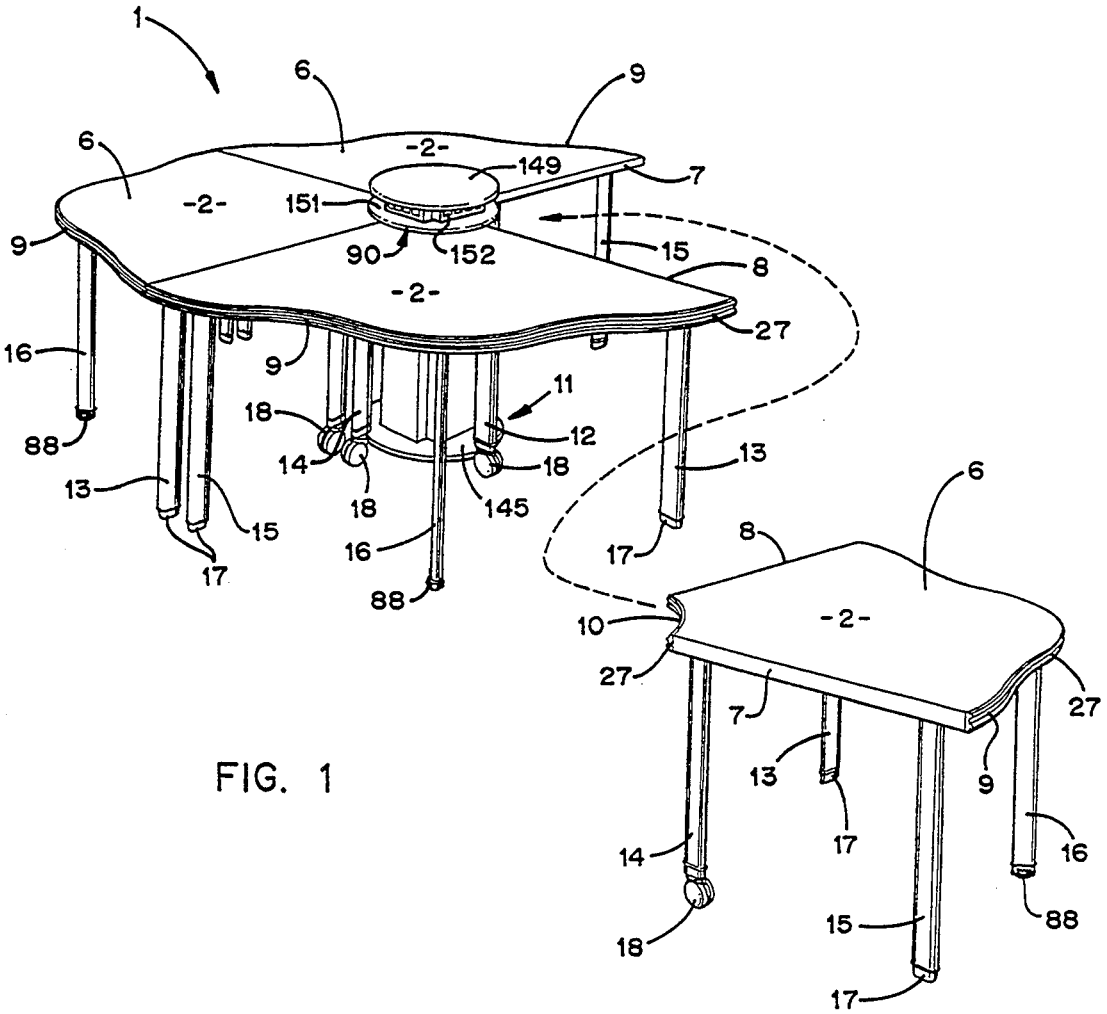
FIG. 1 is a perspective view of a mobile table system embodying the present invention.

For purposes of description herein, the terms "upper," "lower," "left," "rear," "right," "front," "vertical" "horizontal," and derivatives thereof shall relate to the invention as oriented in FIG. 1. However, it is to be understood that the invention may assume various alternative orientations and step sequences, except where it expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a mobile table system embodying the present invention. In the illustrated example, mobile table system 1 includes a plurality of individual mobile tables 2–5, which are configured to be juxtaposed in many different configurations to facilitate a wide variety of both group and individual activities. Each of the tables 2–5 has a top 6, with oppositely oriented side edges 7 and 8 shaped to abut flush with the side edges of like tables, an outer marginal edge 9 configured to accommodate a user thereby, and an inner marginal edge 10 with a generally concave shape which defines a central space 11 when aligned with the inner marginal edges of like tables 2–5. Each of the tables 2–5 includes a plurality of legs 13–16 to support the same freestanding on a floor surface. A first one of the legs 12–16 depends from adjacent the outer marginal edge 9 of top 6 and has a foot 17 at the lower end thereof, and a second one of the legs 12–16 depends from adjacent the inner marginal edge 10 of top 6 and has a roller 18 at the lower end thereof, so as to permit manual translation of the tables 2–5 across the floor surface in a wheelbarrow fashion.

Figure 4:
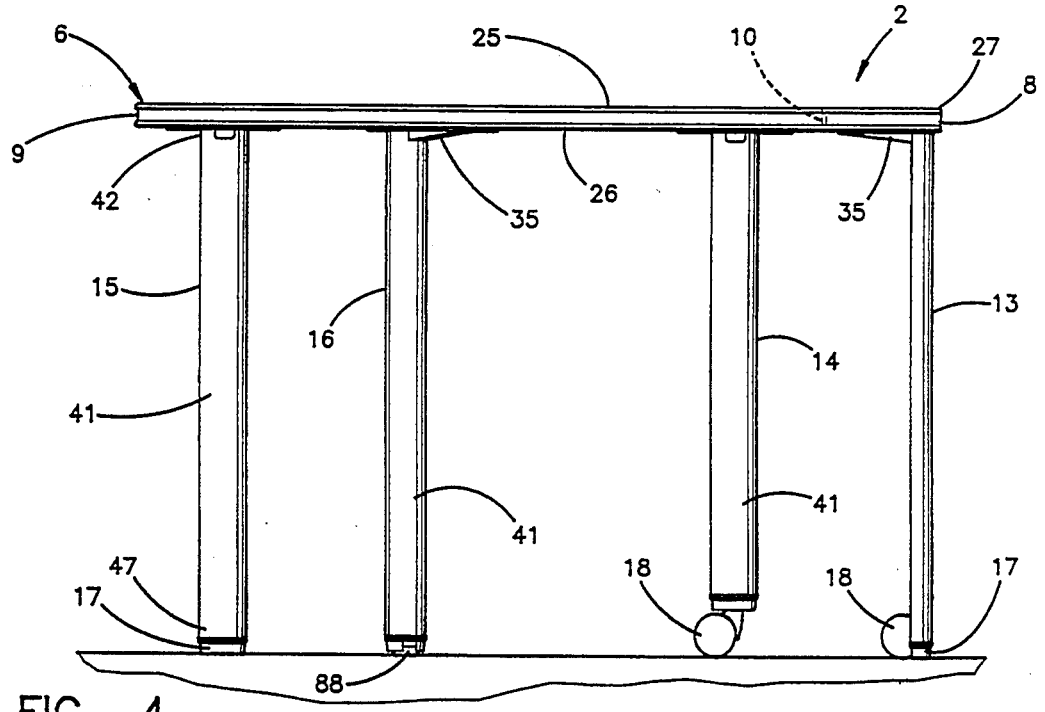
FIG. 4 is a side elevational view of a Type A mobile table embodying the present invention.
Figure 5:
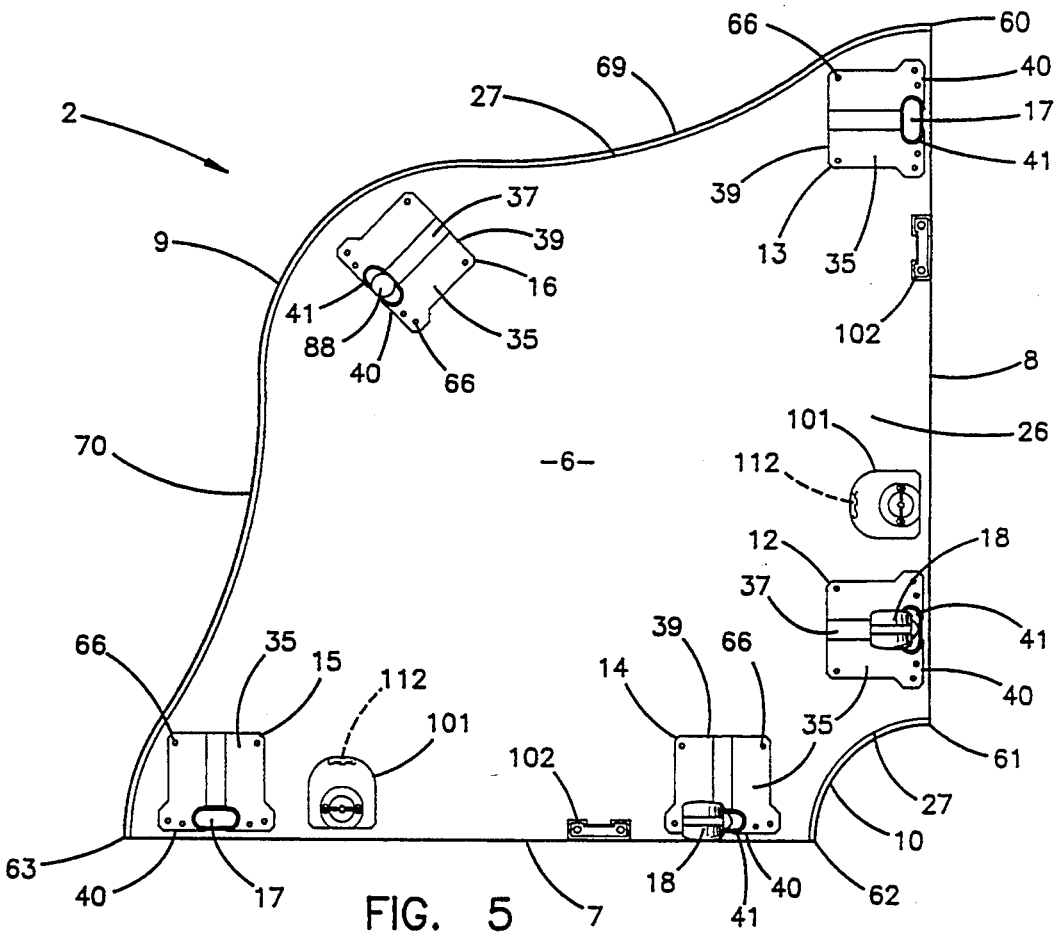
FIG. 5 is a bottom plan view of the Type A mobile table.
Figure 10:
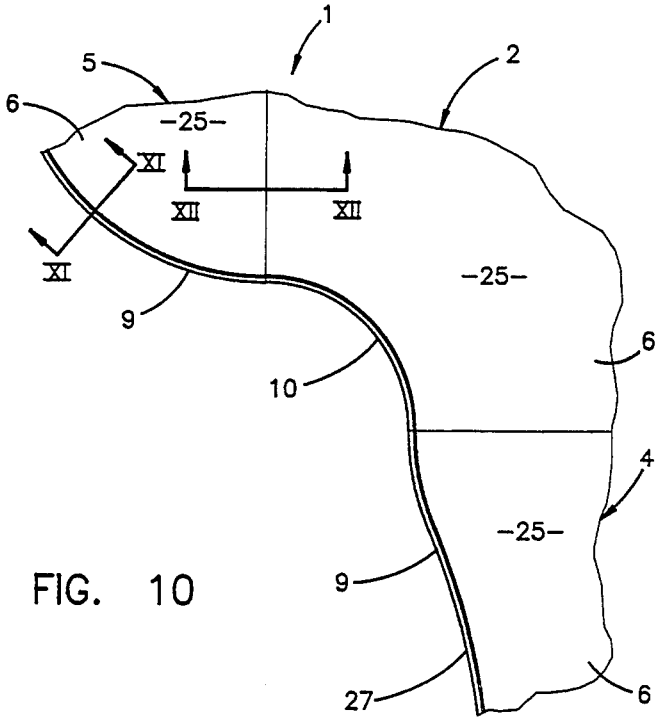
FIG. 10 is a fragmentary top plan view of the Type A mobile table and a Type F and a Type G mobile table positioned side-by-side.
Figure 11:
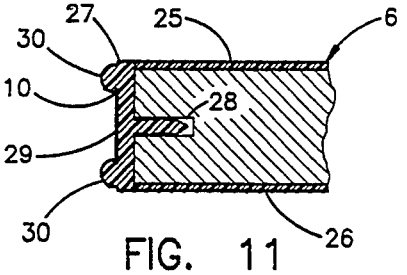
FIG. 11 is a fragmentary, enlarged, vertical cross-sectional view of the mobile tables shown in FIG. 10, taken along the line XI—XI, FIG. 10.
Figure 12:
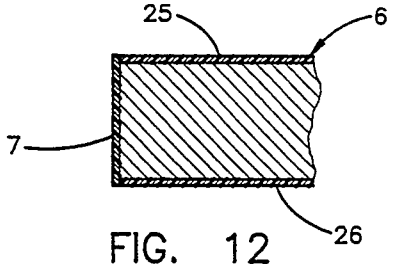
FIG. 12 is a fragmentary, enlarged, vertical cross-sectional view of the mobile tables shown in FIG. 10, taken along the line XII—XII, FIG. 10.

With reference to FIGS. 4 and 5, each of the illustrated tables 2–5 has a similar construction, wherein top 6 includes substantially flat, parallel upper and lower surfaces 25 and 26, respectively. The side edges 7 and 8 of top 6 are of equal length, are oriented in a generally mutually, perpendicular configuration and intersect at their opposite ends outer marginal edge 9 and inner marginal edge 10. As best illustrated in FIG. 12, both of the side edges 7 and 8 of top 6 have a generally flat or planar configuration that is disposed perpendicular to both the upper and lower surfaces 25 and 26 of top 6. The flat vertical orientation of side edges 7 and 8 permits them to mate flush with like side edges 7 and 8 of other tables 2–5 in the system 1, when tables are positioned adjacent one another, as shown in FIG. 10, and described in greater detail hereinafter. The inner marginal edge 10 (FIGS. 4 and 5) of each of the tables 2–5 has a quarter-circular plan configuration, and is contoured to contrast to side edges 7 and 8. The opposite ends of inner marginal edge 10 intersect opposite side edges 7 and 8 in a substantially perpendicular fashion. As best illustrated in FIG. 11, inner marginal edge 10 includes an extruded edge molding 27 extending completely along inner marginal edge 10. Edge molding 28 is specially contoured, and in the illustrated example, has a flat center band 29, with a pair of outwardly protruding arcuate ribs or beads 30 extending continuously along opposite sides thereof. Edge molding 27 provides a protective covering or bumper for the inner marginal edge 10 of top 2, as well as an aesthetically pleasing edge configuration, which contributes to the overall aesthetics of the table. Edge molding 27 may be provided in a wide variety of different shapes or colors, for any given table system 1. The illustrated edge molding 27 has a T-shaped configuration, and is mounted in an associated slot 28 in inner marginal edge 10, although other fastener arrangements may also be used, such as adhesives, etc.

Figure 6:
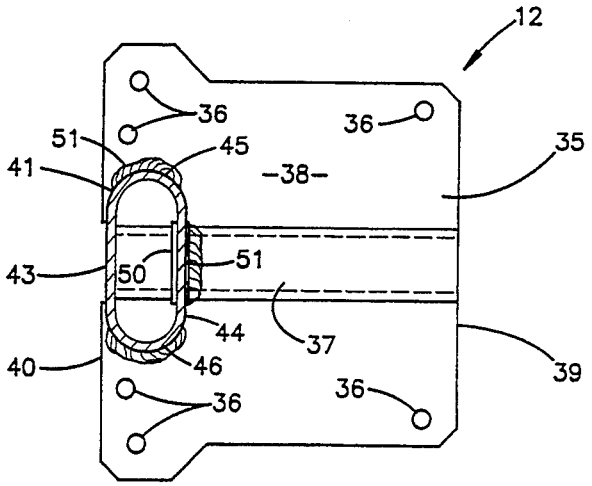
FIG. 6 is a horizontal cross-sectional view of a leg assembly.
Figure 7:
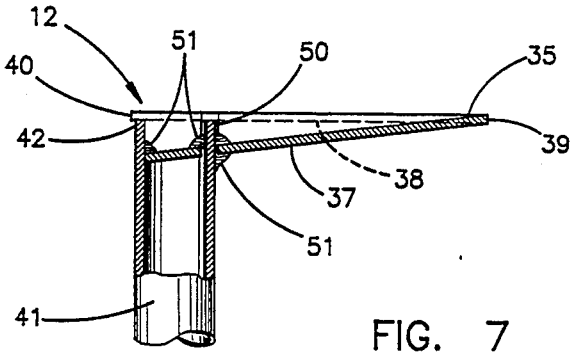
FIG. 7 is a fragmentary vertical cross-sectional view of the leg assembly.

Each of the tables 2–5 also include at least four, generally similar leg assemblies 13–15, which are positioned adjacent the opposite side edges 7 and 8 of top 6. As best illustrated in FIGS. 6 and 7, each of the leg assemblies 12–15 includes an upper plate 35 with six, perpendicularly oriented fastener apertures 36 therethrough to facilitate mounting the same to the lower surface 26 of top 6. Plate 35 includes a reinforcing channel 37, which extends along the lower face 38 thereof from an inward edge 39 of plate 35 to a location adjacent an outward edge 40 thereof. Each of the leg assemblies 12–15 also includes a rigid tubular leg 41, having an upper end 42 thereof securely connected with plate 35. Leg 41 has a generally round horizontal cross-sectional shape, comprising oppositely facing flat side wall portions 43 and 44, and oppositely facing semi-circular end wall portions 45 and 46. Leg 41 is preferably constructed from an extruded metal, plastic or other similar rigid material.

In the illustrated leg assemblies 12–15 (FIGS. 6 and 7), leg 41 is connected with upper plate 35 in the following fashion. The reinforcing channel 37 of plate 35 includes a slot 50 in which the inward side wall 44 of leg 41 is closely received. The outer side wall 43 of leg 41 is positioned adjacent the outer edge of reinforcing channel 37, and multiple welds 51 are made on the adjacent surfaces to rigidly interconnect leg 41 with plate 35 to form a one-piece assembly.

Both of the two leg assemblies 13 and 15 (FIGS. 4 and 5) include a fixed foot 17 mounted at the lower end 47 of its associated leg 41. The illustrated foot 17 is in the form of a stationary glide, adapted to abuttingly engage a floor surface, and is preferably constructed from a durable anti-friction material, such as a synthetic resin material, including nylon, or the like. Glide 17 is closely received within the open lower end 47 of leg 41, and is rigidly fixed thereto by means such as an adhesive or other similar fastener. Both of the two other leg assemblies 12 and 14 have a ground engaging wheel or roller mechanism 18 mounted in the lower end 47 of its associated leg 41 to facilitate translation of mobile tables 2–5 across a floor surface in wheelbarrow fashion. The illustrated roller 18 is in the form of a caster, which is pivotally mounted to the lower end 47 of leg 41 for rotation about a generally vertical axis, so as to permit translation of mobile tables 2–5 in all directions. The illustrated caster 18 has a conventional, dual-wheel construction that provides additional stability and durability.

Figure 2:
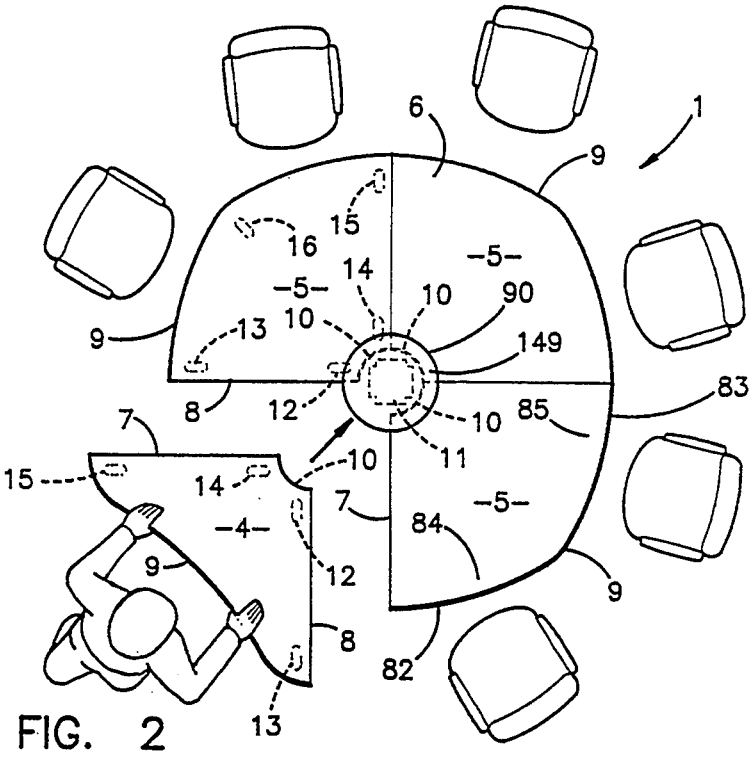
FIG. 2 is a top plan view of the mobile table system, wherein adjacent tables are configured in a generally closed grouping.
Figure 3:
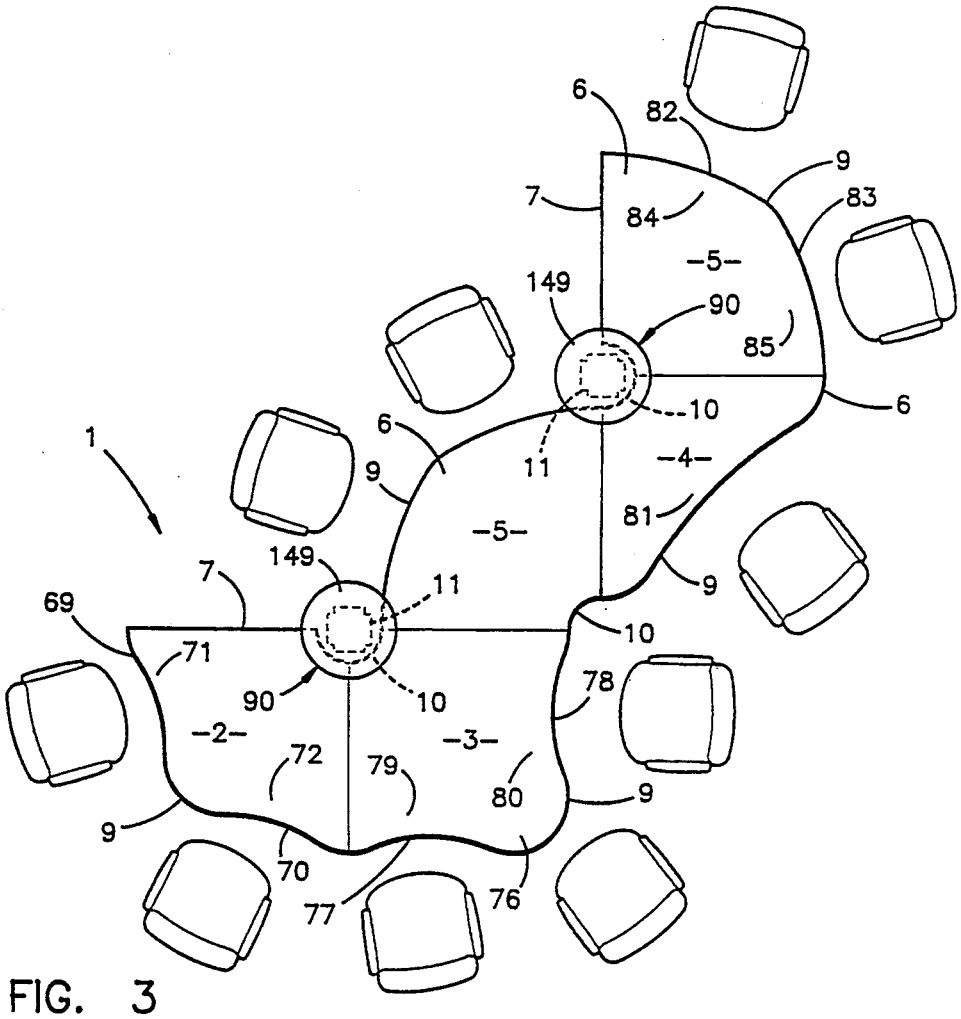
FIG. 3 is a top plan view of the mobile table system, wherein adjacent tables are configured in a generally elongate grouping.

As best shown in FIGS. 4 and 5, each of the illustrated tables 2–5 includes two fixed leg assemblies 13 and 15, and two castered leg assemblies 12 and 14 mounted adjacent side edges 7 and 8 on the lower surface 26 of top 6. The two fixed leg assemblies 13 and 15 are positioned adjacent the outer marginal edge 9 of top 6, whereas the two castered leg assemblies 12 and 14 are positioned adjacent the inner marginal edge 10 of top 6. In each of the leg assemblies 12–15, the associated upper plate 35 is oriented with its outer edge 40 being positioned adjacent to, and parallel with, the adjacent side edges 7 and 8 of top 6. Leg assemblies 12–15 are mounted on the lower surface 26 of the top 6 in a symmetrical pattern, such that adjacent legs 12–15 of any of the tables 2–5 will align when the tables are positioned adjacent one another, as shown in FIGS. 1–3. More specifically, right-hand leg assemblies 12 and 13 are positioned equidistantly from their next adjacent table top corners 60 and 61, respectively, and left-hand leg assemblies 14 and 15 are also spaced equidistantly from their next adjacent table top corners 62 and 63, respectively. Furthermore, the spacing between each leg assembly 12–15 and its adjacent table top corner 60–63 is substantially identical, such that associated legs 41 will align when adjacent tables 2–5 are configured in each of the different possible arrangements. Each of the leg assemblies 12–15 is securely attached to the lower surface 25 of top 6 by conventional fasteners, such as the illustrated wood screws 66, or the like.

As best shown in FIGS. 2 and 3, the illustrated tables 2–5 have differently shaped tops 6, such that mobile table system 1 can be configured in a variety of different ways to achieve variant shapes for both group and individual activities. The outer marginal edges 9 of tables 2–5 have a different plan configuration from one table to the next to accommodate different activities. However, in each of the tables 2–5, the opposite ends of its associated outer marginal edge 9 intersect the associated side edges 7 and 8 in a substantially perpendicular relationship. Also, the outer marginal edges 9 of each of the mobile tables 2–5 have a similarly contoured shape, which is identical to the contoured shape of the inner marginal edges 10. In the illustrated examples, the outer marginal edges 9 of each of the mobile tables 2–5 include the previously described edge molding 27, which is shown in detail in FIG. 11.

The illustrated mobile table 2 (FIG. 3), which is referred to as a Type A table, has an undulating outer marginal edge 9, with two concave portions 69 and 70 oriented at approximately 45° with respect to one another, which define two individual work areas 71 and 72 on the top 6 of mobile table 2. The illustrated mobile table 3, which is referred to as a "Type B" table, also has an undulating outer marginal edge 9 and includes an outwardly projecting center portion 76, with a pair of concave portions 77 and 78 oriented at approximately 90° with respect to one another, which define two separate work areas 79 and 80 on the top 6 of table 3. The illustrated mobile table 4, which is referred to as a "Type G" table, has outer marginal edge 9 in a generally inwardly curved convex configuration which forms a single work area 81. The illustrated mobile table 5, which is referred to as a "Type F" table, has its outer marginal edge 9 in a generally outwardly arcuate shape, with two arcuate portions 82 and 83 intersecting at the center of edge 9 to define two separate work areas 84 and 85 on the top 6 of table 5. It is to be understood that mobile table system 1 also contemplates a wide variety of additional tables, with differently shaped tops (not shown) that can be used in conjunction with the illustrated tables 2–5 in the fashion disclosed herein. For instance, mobile table system 1 may also include a table, with a top having a quarter-circular plan configuration, a rectangular or square plan configuration, as well as other variations of those top shapes disclosed herein.

As best illustrated in FIGS. 4 and 5, those mobile tables 2–5 which have a top 6 with a portion cantilevered outwardly from leg assemblies 13 and 15 a substantial distance are provided with a fifth leg assembly 16 for additional stability. In the illustrated example, Type A table 2, Type B table 3, and Type F table 5, each include a fifth leg assembly 16, which is located intermediate leg assemblies 13 and 15, adjacent the outer marginal edge 9 of top 6. For example, in the Type A table 2 shown in FIGS. 4 and 5, the fifth leg assembly 16 is spaced equidistantly from opposite leg assemblies 13 and 15. The fifth leg assembly 16 is substantially identical to fixed leg assemblies 13 and 15, except that foot 17 is replaced by a vertically adjustable glide assembly 88, which is mounted in the lower end 47 of leg 41. Vertically adjustable glide 88 permits the height of leg assembly 16 to be varied, so as to ensure stability on non-level and/or uneven floor surfaces. The outer edge 40 on the upper plate 35 of fifth leg assembly 16 is oriented substantially perpendicular to a tangent line drawn at the central curved area of outer marginal edge 9.

In operation, mobile table system 1 functions in the following fashion. A plurality of mobile tables 2–5 are typically stationed in the building room in which group activities take place, such as a conference room, cafeteria, restaurant, or other similar environment. Tables 2–5 are each freestanding, and can be used in a stand-alone condition anywhere in the room, including against a wall, in a corner, or simply by itself. Tables 2–5 can also be configured in a cluster or group, so as to accommodate multiple user activities, such as for conferencing, or the like. When one or more table groupings are desired, tables 2–5 can be easily configured in a wide variety of different shapes and sizes by a single user of even modest strength. The user simply grasps the top 6 of a selected table 2–5 adjacent a central portion of its outer marginal edge 9, such as in the fashion illustrated in FIG. 2. The user then lifts slightly upwardly at the outer marginal edge 9 of top 6, so as to elevate the fixed feet 17 from the floor surface, so that the weight of the table is shifted onto casters 18. The selected table 2–5 is then translated across the floor surface in a wheelbarrow fashion to its desired location. As shown in Figs. 1–3, tables 2–5 can be configured in groups with a generally closed marginal configuration, as shown in FIGS. 1 and 2, or in a generally elongate configuration, as shown in FIG. 3. In all such configurations, the user simply positions the selected tables 2–5 with their side edges 7 and 8 aligned and adjacent one another, so as to form a substantially continuous, enlarged worksurface, with multiple work areas along both sides of the grouping.

The perpendicular relationship between the side edges 7 and 8, and the ends of inner marginal edge 10 and outer marginal edge 11 on each of the mobile tables 2–5, as well as the equal length of each of the side edges 7 and 8 thereof, permit any one of the mobile tables to be matched side-by-side with another table. For example, in the table system 1 shown in FIG. 1, four Type A mobile tables 2 are in the process of being configured in a closed shape, and in the table system shown in FIG. 2, three Type F mobile tables 5 are in the process of being configured in a closed shape, along with one Type G mobile table 4. In the table system 1 shown in FIG. 3, at least one of each of the different tables 2–5 is included, in which no two of any one table type is positioned adjacent one another. More specifically, two type F tables 5 are included, the outermost one of which has its inner marginal edge 10 oriented inwardly in a partially closed relationship with the inner marginal edge 10 of adjacent Type G table 4, and the outer marginal edge 9 of adjacent Type F table 5. The innermost one of the two type F tables 5 has its inner marginal edge 10 oriented outwardly in a fully open relationship with the outer marginal edge 9 of adjacent Type G table 4, and the outer marginal edge 9 of adjacent Type B table 3. Because the inner and outer marginal edges 9 and 10 of each type of mobile tables 2–5 are identical, they match, regardless of the orientation of the table, as shown in FIG. 10. Also, the contrasting flat side edges 7 and 8 of mobile tables 2–5 help make aligning adjacent tables an immediately intuitive process. The location of castered leg assemblies 12 and 14 adjacent the inner marginal edges 10 of tables 2–5 also help the user in translating the tables over the floor surface, and accurately guiding tables 2–5 into a selected grouping.

When tables 2–5 are configured in a closed arrangement, as illustrated in FIG. 2, the inner marginal edges 10 of adjacent tables 2–5 are aligned to define the central space 11, which in the example illustrated in FIG. 2, has a circular top plan shape. A utility post 90 may be located within central space 11, as discussed below, to provide electrical power, communications, data lines, etc., to the table grouping.

Figure 8:
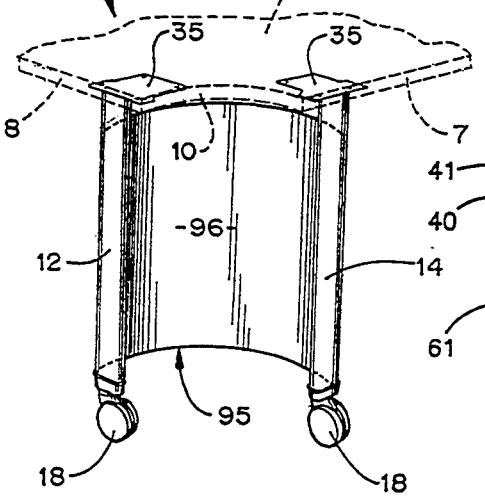
FIG. 8 is a perspective view of an optional leg panel, shown attached to the Type B mobile table.
Figure 9:
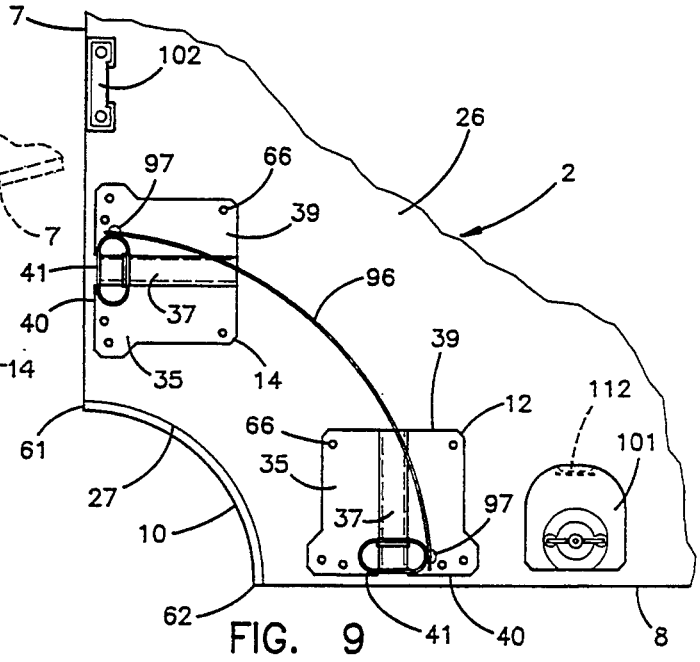
FIG. 9 is a fragmentary bottom plan view of the Type A mobile table with the optional leg panel installed.
Figure 29:
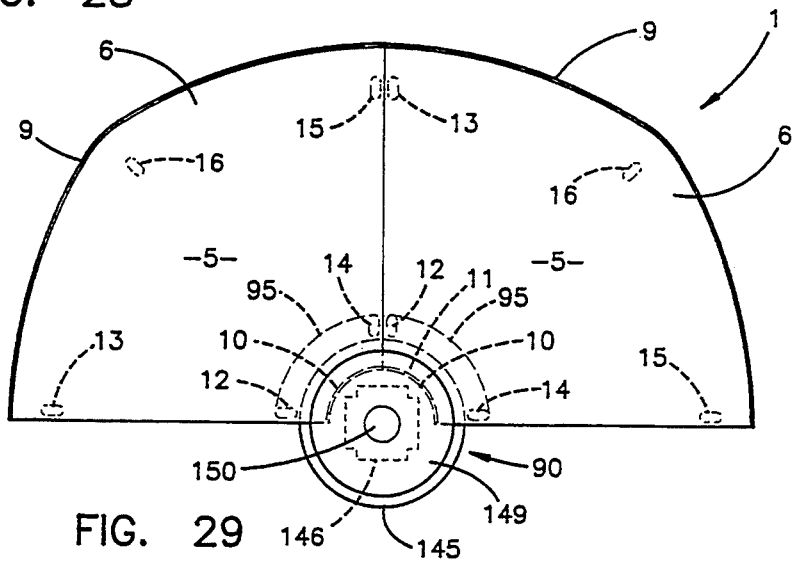
FIG. 29 is a top plan view of the utility post, shown with two mobile tables positioned thereabout.
Figure 30:
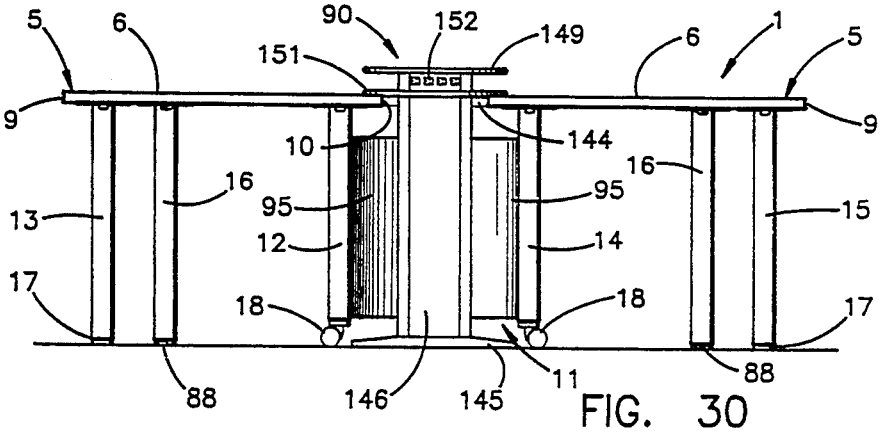
FIG. 30 is a side elevational view of the utility post and mobile tables shown in FIG. 29.

With reference to FIGS. 8 and 9, an optional leg cover 95 is provided to enclose the space between castered legs 12 and 14. The illustrated leg cover 95 comprises a curved panel 96, which extends vertically between the upper and lower ends 42 and 47 of legs 41, and horizontally between the front edges 45 of legs 41. Curved panel 96 includes opposite side edges attached to legs 41 by fasteners 97. Leg panel 96 physically interconnects leg assemblies 12 and 14, so as to rigidify the same, and also encloses the central space 11 when tables 2–5 are configured in a closed grouping, as illustrated in FIGS. 29 and 30.

Figure 13:
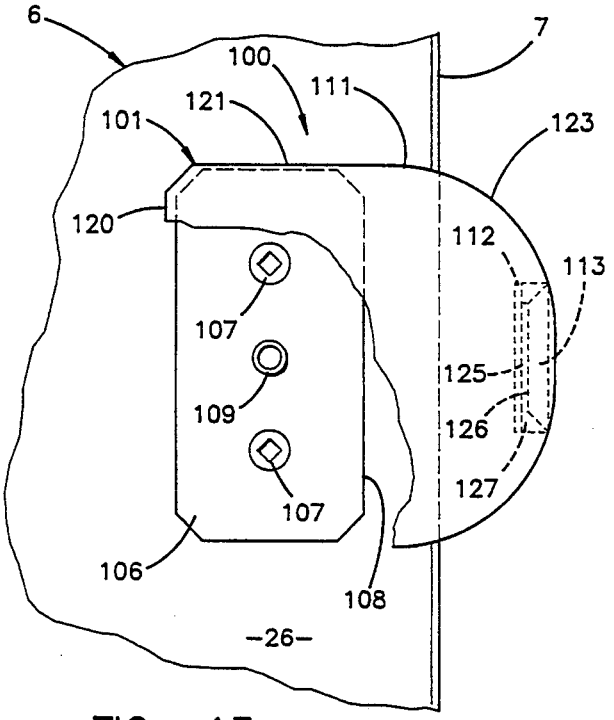
FIG. 13 is a bottom plan view of a male latch member shown attached to an associated top for interconnecting adjacent mobile tables, wherein a portion thereof has been broken away to reveal internal construction.
Figure 14:
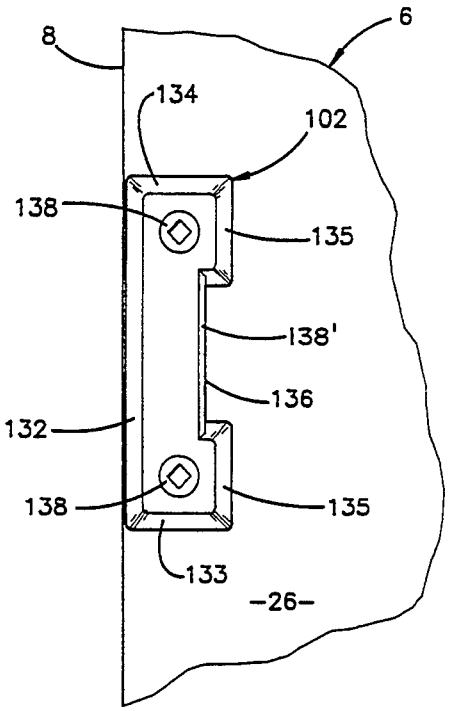
FIG. 14 is a bottom plan view of a female latch member shown attached to an associated top for interconnecting adjacent mobile tables.
Figure 15:
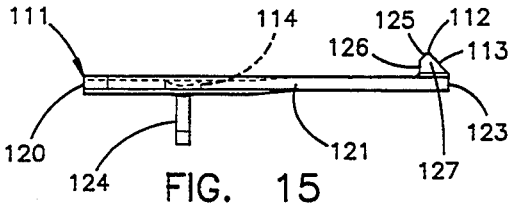
FIG. 15 is a side elevational view of a cam element of the male latch member.
Figure 16:
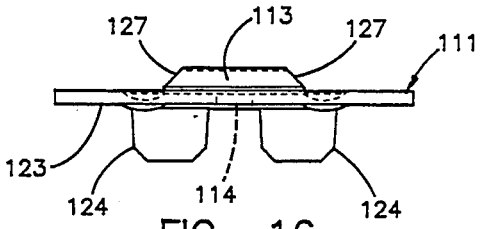
FIG. 16 is a front elevational view of the cam.
Figure 17:
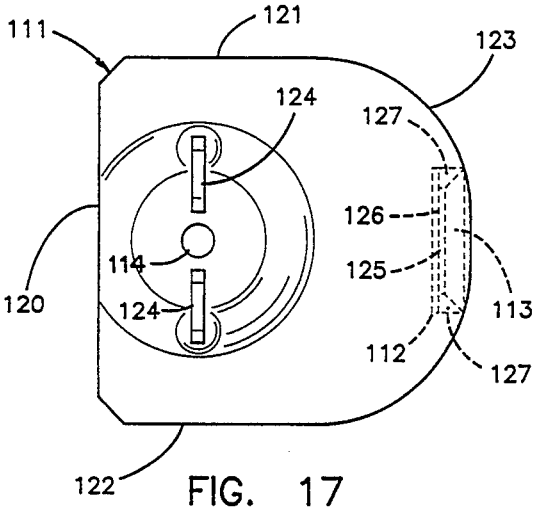
FIG. 17 is a bottom plan view of the cam.
Figure 18:
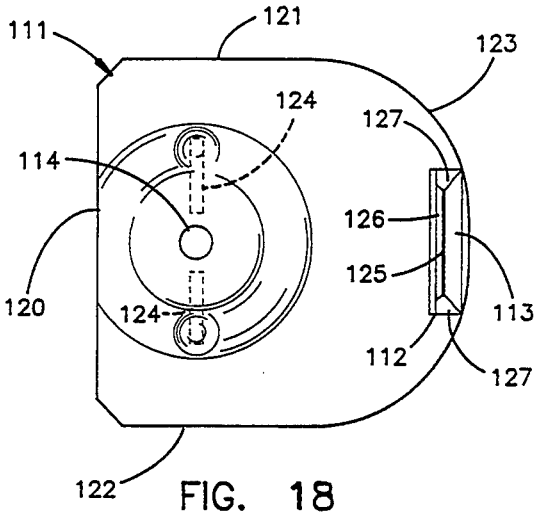
FIG. 18 is a top plan view of the cam.
Figure 19:
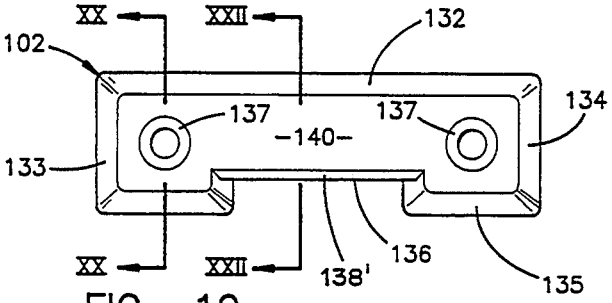
FIG. 19 is a bottom plan view of a latch plate element of the female latch member.
Figure 20:
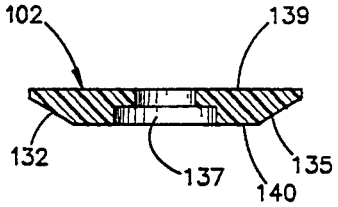
FIG. 20 is a vertical cross-sectional view of the latch plate, taken along the line XX—XX, FIG. 19.
Figure 21:
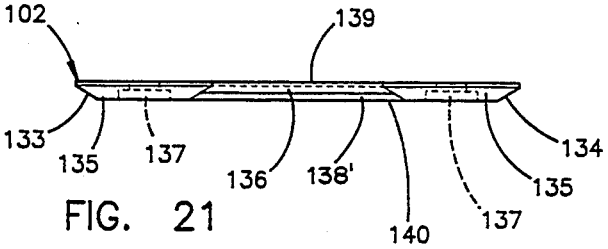
FIG. 21 is a rear elevational view of the latch plate.
Figure 22:
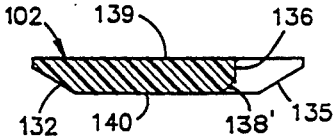
FIG. 22 is a fragmentary, enlarged, vertical cross-sectional view of the latch plate, taken along the line XXII—XXII, FIG. 19.

The reference numeral 100 (FIGS. 13 and 14) generally designates a latch arrangement, which may be used in conjunction with mobile table system 1, to prevent adjacent tables 2–5 from being inadvertently separated. Latch arrangement 100 includes a male latch assembly 101, and a female latch plate 102, which are mounted on the lower surfaces 26 of adjacent table tops 6 to retain the side edges 7 and 8 thereof together in a generally flush and aligned condition.

Figure 25:
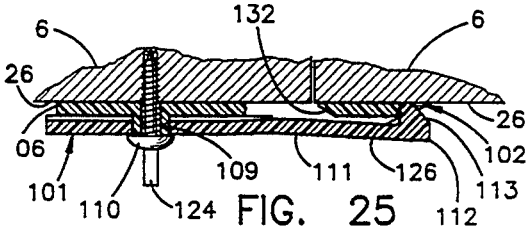
FIG. 25 a vertical cross-sectional view of the engaged male and female latch members, taken along the line XXV—XXV, FIG. 24.

The illustrated male latch assembly 101 (FIG. 13) comprises a base plate 106 having a generally rectangular plan configuration, with a pair of fasteners 107 extending through mating apertures therein to securely mount male latch assembly 101 on the lower surface 26 of table top 6. Base plate 106 includes an outer or forward edge 108, which is oriented substantially parallel with the side edge 7 of table top 6, and is spaced inwardly therefrom a pre-selected distance. Base plate 106 also includes a downwardly extending, cylindrical boss 109, which receives a mating fastener 110 (FIGS. 25 and 27) therein, as described in greater detail below. Male latch assembly 101 (FIG. 13) also includes a resilient arm 111, which is connected with base plate 106, and includes an upwardly protruding barb portion 112 disposed adjacent the free end thereof, with a beveled outer edge 113, that selectively engages female latch plate 102, as discussed below. The illustrated latch arm 111 (FIGS. 15–18) is in the form of a cam, having a central aperture 114 therethrough, which is shaped to receive the cylindrical boss 109 of base plate 106 therein, as shown in FIGS. 25 and 27. Cam 111 is resiliently flexible in a vertical direction, and may be constructed from a molded plastic, or the like. A fastener 110 retains cam 111 in assembly with base plate 106, and permits cam 111 to be rotated along a horizontal plane between an extended position, as shown in FIGS. 23-27, and a retracted position, as shown in FIG. 5. Cam 111 (FIGS. 15–18) includes a straight end edge 120, a pair of straight mutually parallel side edges 121 and 122, and an arcuate end edge 123 positioned opposite straight end edge 120. A pair of wings 124 depend from the lower surface of cam 111 on opposite sides of aperture 114, and facilitate manually grasping and rotating cam 111 between its fully extended and fully retracted positions.

The barb portion 112 (FIGS. 15–18) of cam 111 is positioned adjacent the arcuate end edge 123 thereof, and has an elongate tooth configuration, comprising beveled forward edge 113, and rearward edges 125 and 126. Rearward edge 126 is disposed in a substantially vertically orientation, whereas rearward edge 125 is orientated at an angle thereto to facilitate pull-apart detachment from female latch plate 102. The opposite end edges 127 of barb portion 112 are tapered inwardly to assist in non-linearly engagement with female latch plate 102, as discussed below.

The illustrated female latch plate 102 (FIGS. 19–22) has a generally rectangular plane configuration, comprising forward edge 132, opposite side edges 133 and 134, and a rearward edge 135, with a recessed catch edge 136 along the center thereof, which selectively engages the barb portion 112 of cam 111 to form a detachable snap lock. Female latch plate 102 includes a pair of perpendicularly oriented fastener apertures 137 therethrough into which fasteners 138 (FIG. 23) are inserted to securely mount the same to the lower surface 26 of top 6 adjacent side edge 8. Latch plate edges 132–135 are inclined or beveled at an angle of approximately 30° to facilitate sliding contact with the barb portion 112 of cam 111, as described below. In contrast, catch edge 136 is oriented substantially perpendicular to the upper and lower surfaces 139 and 140 of latch plate 102, except for a chamfered lowermost edge 138' adjacent lower plate surface 140.

Preferably, each table 2–5 associated with mobile table system 1 includes at least one male latch 101 and one female latch 102 disposed adjacent the opposite side edges 7 and 8 of top 6 to mate with similar latch members on adjacent tables to help prevent the adjacent tops 6 from inadvertently separating during use. In the example illustrated in FIG. 5, Type A table 2 includes a male latch 101 and a female latch 102 on each of the top side edges 7 and 8, such that table 3 can be connected with like tables 2–5 in a variety of different configurations. Both male latch 101 and female latch 102 are spaced along side edges 7 and 8 equidistantly from the adjacent corners 61–63, such that they will align properly with adjacent female and male latch members, respectively. Also, the relative position of male latch 101 and female latch 102 is reversed with respect to top side edges 7 and 8, so that they mate with oppositely gender latch members. For example, in the Type A table 2 illustrated in FIG. 5, on side edge 8, female latch plate 102 is located nearest the outermost corner 60, whereas on opposite side edge 7, male latch 101 is located closest to the outermost corner 63.

Figure 23:
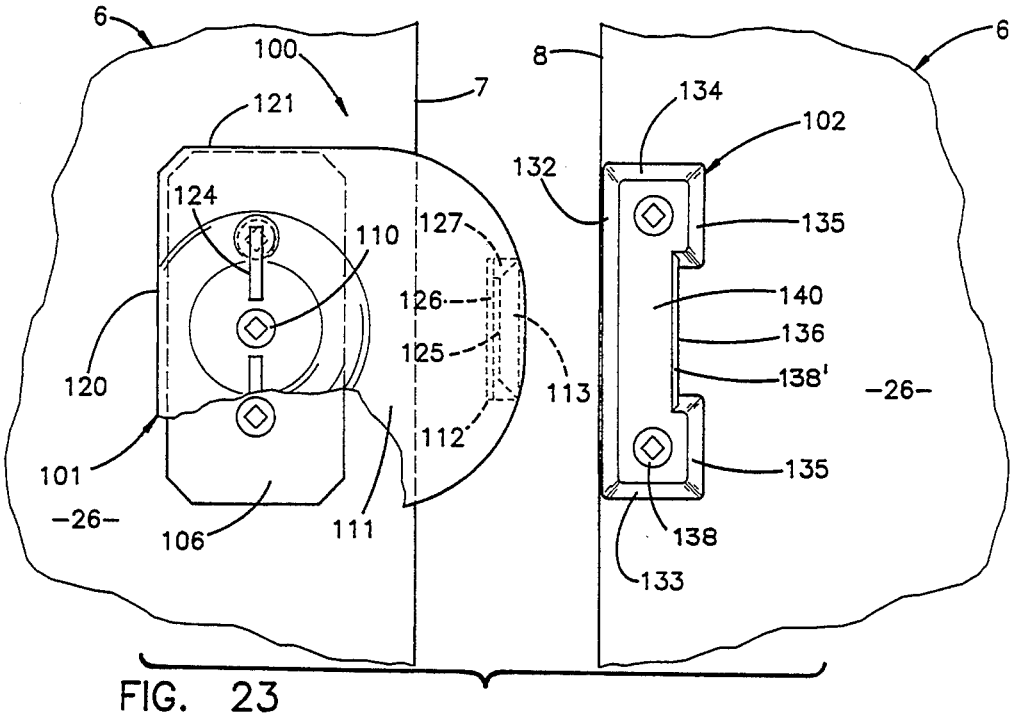
FIG. 23 is a fragmentary, bottom plan view of adjacent mobile tables immediately prior to being latched, with the cam shown in a fully extended position.
Figure 24:
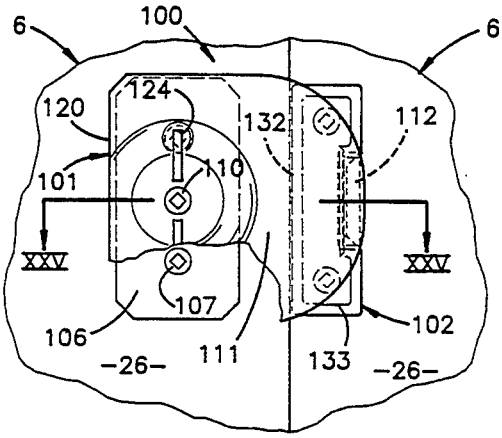
FIG. 24 is a fragmentary, bottom plan view of the mobile tables shown in FIG. 23, wherein the male and female latch members are shown fully engaged.

In operation, latch arrangement 100 functions in the following manner. When tables 2–5 are to be used in a stand-alone condition, each of the cams 111 is rotated to its fully retracted position underneath associated top 6, so that it will be out of the way, and will not interfere with the use or appearance of the associated table 2–5. When tables 2–5 are to be positioned in a group, as shown in FIGS. 1–3, the cams 111 associated with those table edges to be joined are rotated to their fully extended outwardly protruding position, as illustrated in FIG. 23. Normally, two adjacent tables 2–5 are interconnected by aligning the adjacent side edges 7 and 8 and converging the two tables in a direction generally perpendicular to side edges 7 and 8. In this environment, the inclined leading edge 113 of barb portion 112 engages the inclined forward edge 132 of latch plate 102, and abuttingly deflects over the lower surface 140 of latch plate 102 to snap into engagement with catch edge 136. The rearward edge 126 of barb portion 112 engages securely behind the vertical catch edge 136 of latch plate 102. The resiliency of cam arm 111 helps retain the barb portion 112 of cam 111 securely in engagement with catch edge 136 to help retain the side edges 7 and 8 of adjacent tables together, even when the tables are bumped or jostled. To separate adjacent tables, the user diverges the adjacent tables, by pulling one of the two outwardly in a fashion similar to that illustrated in FIG. 2, but in reverse. The inclined inner edge 125 of barb portion 112, in conjunction with the chamfered edge 138' of catch plate 102 permits the barb portion 112 to dislodge from catch edge 136. Hence, adjacent tables can be readily separated, without having to manipulate the latch members from underneath the tables.

Figure 26:
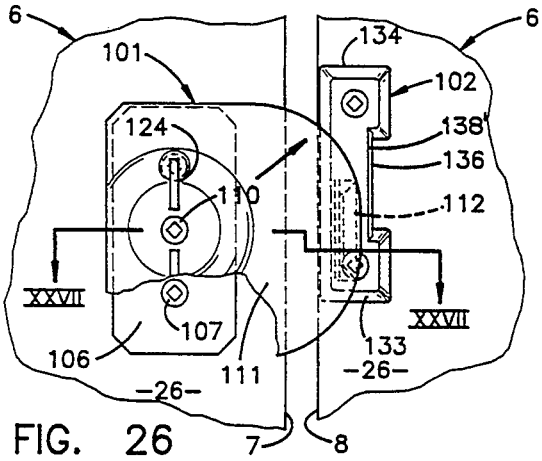
FIG. 26 is a fragmentary, bottom plan view of adjacent mobile tables, with the latch cam shown in its extended position, and adjacent tables being converged along an angle.
Figure 27:
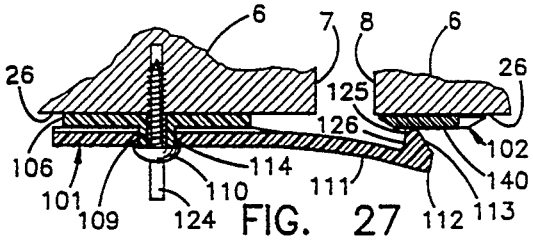
FIG. 27 is a fragmentary, vertical cross-sectional view of the adjacent mobile tables shown in FIG. 26, taken along the line XXVII—XXVII, FIG. 26.

When it is not possible to converge adjacent tables 2–5 in a perpendicular direction, such as when the last table in a closed group is to be connected, as illustrated in FIGS. 1 and 2, in this environment, cams 111 are once again rotated to their fully extended position, as illustrated in FIGS. 26 and 27. The two tables are then converged along an angle, or line that is not substantially parallel to the adjacent side edges 7 and 8, such as in the direction of the arrow shown in FIG. 26. As the two tables are converged, the inclined edge 113 of cam 111 abuts the outermost one of the beveled end edges 133 and 134 of latch plate 102, and ramps or wedges upwardly thereover across the lower surface 140 of latch plate 102, as shown in FIGS. 26 and 27, until barb portion 112 snaps upwardly into place against catch edge 136. The inclined side edges 127 of barb portion 112 ensure smooth engagement between barb portion 112 and latch plate 102, as they come into engagement.

Figure 28:
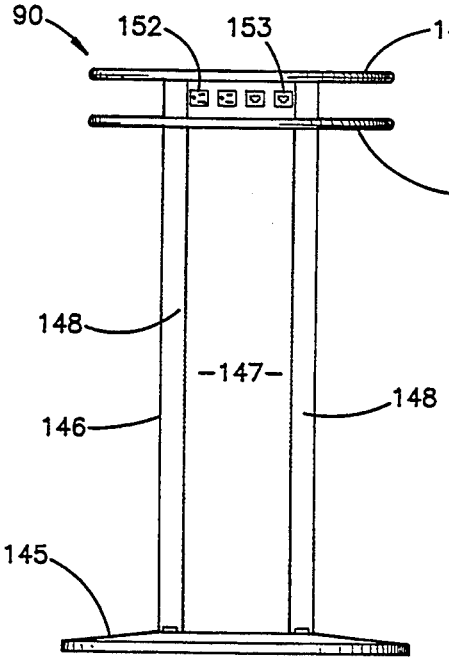
FIG. 28 is a front elevational view of a utility post embodying the present invention.
Figure 31:
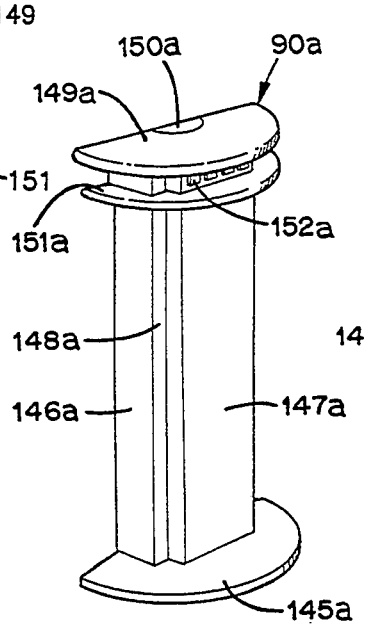
FIG. 31 is a perspective view of an alternative utility post, having a semi-circular plan configuration.

As best illustrated in FIGS. 28–30, utility post 90 is configured to be positioned in the center space 11 created by tables 2–5 arranged in a closed group, and comprises a base 145 with a column 146 upstanding therefrom. The illustrated column 146 has a substantially square horizontal cross-sectional configuration, with flat, oppositely facing side panels 147, and cutaway corner areas 148. As illustrated in FIGS. 29 and 30, base 145 has a substantially circular plan configuration, with an outside diameter that is slightly smaller than the outside diameter of central space 11, so as to avoid interference with the casters 18 on tables 5. Column 146 has an outside dimension which is substantially smaller than the outside diameter of central space 11, so as to create an annular space or gap 144 with respect to the inner marginal edges 10 of tables 5. Utility post 90 includes a circular top cap 149 mounted on the upper end of column 146, with a removable cover 150 attached thereto to access the interior of column 146. A plurality of utility ports, such as power receptacles 152 and data receptacles 153, are mounted on the faces 147 of pedestal 146 below top cap 149, and above the height of table tops 6, and provide utilities to the table grouping. As shown in FIG. 30, when optional leg cover panels 96 are used with tables 2–5, the center space 11 is enclosed so as to isolate utility post 90, and conceal the same from view. Wires and/or other utility conduits (not shown) can be routed through center space 11.

The illustrated utility post 90 (FIGS. 28–30) includes a circular cover plate or apron 151 mounted on column 146 at a location spaced slightly above the height of table top 6, and below top cap 149. Apron 151 has a circular shape similar to that of top cap 149, with an outside diameter which extends over and overlaps the inner marginal edges 10 of adjacent tables 2–5, so as to close gap 144, and create a neat appearance. It is to be understood that apron 151 may be deleted, and that bumpers (not shown) may be mounted on the side panels 147 of utility post 90 at an elevation commensurate with the inner marginal edges 10 of mobile tables 2–5, to facilitate positioning mobile tables 2–5 concentrically about utility post 90.

The reference numeral **90*a* generally designates another embodiment of the present utility post, having a semi-circular plan configuration. Since semi-circular utility post 90*a* is similar to the previously described utility post 90, similar parts appearing in FIGS. 28–30 and 31, respectively, are represented by the same, corresponding reference numeral, except for the suffix "a" in the numerals of the latter. Utility post 90*a* is basically one-half of utility post 90, and is designed to be used against a wall, or other similar setting, wherein only two tables 2–5 are positioned adjacent to post 90*a*** in a closed configuration.

Figure 32:
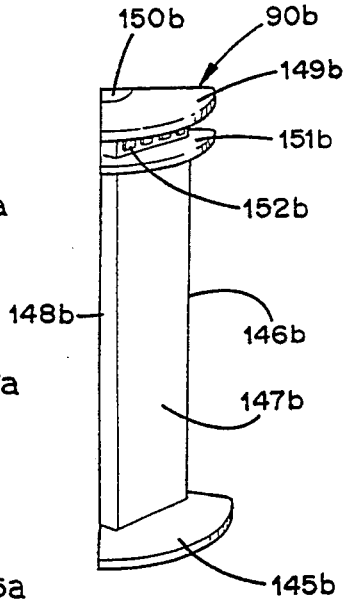
FIG. 32 is a perspective view of another alternative embodiment of the utility post, having a quarter-circular plan configuration.

The reference numeral **90*b* (FIG. 32) generally designates yet another embodiment of the present utility post 90, having a quarter circular plan configuration. Since utility post 90*b* is similar to the previously described utility posts 90 and 90*a*, similar parts appearing in FIGS. 28–31 and 32, respectively, are represented by the same, corresponding reference numeral, except for the suffix "b" in the numerals of the latter. Utility post 90*b* is basically one-quarter of utility post 90, and is designed for use in a corner of a room, or other similar setting, wherein a single table 2–5 is positioned adjacent to post 90*b*** in a closed configuration.

Mobile table system 1 provides a plurality of mobile tables 2–5 with differently shaped tops that can be juxtaposed in many different configurations to provide substantial flexibility, and facilitate a wide variety of both group and individual activities. Each of the tables 2–5 is quite sturdy and durable, yet can be easily reconfigured by a single user with even modest strength by translating tables 2–5 across the floor surface in a wheelbarrow fashion. The latch arrangement 101 on tables 2–5 helps prevent adjacent tables from being inadvertently separated, yet permits them to be manually pulled apart when desired without latch manipulation. The male latches 101 are retractable to permit each table 2–5 to be used in a stand-alone condition, and will engage even when adjacent tables are converged along an angle. The utility posts **90–90*b* provide power, communications, data, and the like, to the various table groupings, and are configured to be received within the center space 11 created when tables 2–5 are arranged in a closed configuration. The inner and outer marginal edges 9 and 10 of each of the table tops 6 are similarly configured, so that they match when adjacent tables are oriented in any of several different configurations. Whether configured individually or in combination, mobile table system 1** moves and changes as fast as today's workers, and is responsive to a wide range of communication styles and work process needs.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A mobile conference table, comprising:

a top having a pair of oppositely oriented, mutually tapered side edges configured to abut generally flush with similar side edges of adjacent like mobile tables to create an enlarged substantially continuous open worksurface, an outer marginal edge configured to accommodate a user thereby, and an inner marginal edge with a shape which defines a central space when aligned with similar inner marginal edges of adjacent like mobile tables; said top side edges tapering inwardly toward each other from said outer marginal edge to said inner marginal edge; and a plurality of legs connected with said top and depending therefrom to support said mobile table on a floor surface in a freestanding fashion; first and second ones of said legs having upper ends thereof connected with said top at locations disposed adjacent to said outer marginal edge at opposite sides thereof, and lower ends thereof with feet to abut the floor surface, and third and fourth ones of said legs having upper ends thereof connected with said top at locations disposed adjacent to said inner marginal edge at opposite sides thereof, and lower ends thereof with rollers to permit manual translation of said mobile table across the floor surface in wheelbarrow fashion, so that like mobile tables can be easily reconfigured by a single person to accommodate different groups and meeting activities.

2. A mobile table as set forth in claim 1, wherein:
said roller comprises a caster pivotal about a generally vertical axis to facilitate translation of said mobile table in all directions.

3. A mobile table as set forth in claim 2, including:
a back panel extending between and connected with said second and third legs to rigidify the same and enclose the central space.

4. A mobile table as set forth in claim 3, including:
a utility post supported on the floor surface, and shaped to be received in the central space created by adjacently positioned like mobile tables.

5. A mobile table as set forth in claim 4, including:
a latch connected with said mobile table, and configured to detachably interconnected adjacent like mobile tables in a pull-apart fashion.

6. A mobile table as set forth in claim 5, wherein:
said outer marginal edge and said inner marginal edge have a substantially identical shape such that said inner marginal edge matches the outer marginal edge of an adjacent like mobile table top.

7. A mobile table as set forth in claim 6, wherein:
a fifth one of said legs has an upper end thereof connected with said top at a location disposed adjacent to said outer marginal edge intermediate said third and fourth legs, and a lower end with a vertically adjustable glide to abut the floor surface.

8. A mobile table as set forth in claim 7, wherein:
said outer marginal edge of said top is curved to create at least one work area.

9. A mobile table as set forth in claim 8, wherein:
said latch is configured to selectively engage similar latches of adjacent like mobile tables even when the side edges of like mobile tables are manually converged along a line of motion which is not substantially perpendicular to said side edge.

10. A mobile table as set forth in claim 9, wherein:
said outer marginal edge and said inner marginal edge are contoured.

11. A mobile table as set forth in claim 10, wherein:
said side edges are flat, and disposed substantially perpendicular to Upper and lower surfaces of said top.

12. A mobile table as set forth in claim 11, wherein:
said inner marginal edge has a quarter-circle plan shape.

13. A mobile table as set forth in claim 12, wherein:
said latch includes a male latch member and a female latch member, which are positioned adjacent each of said side edges and are spaced equidistant from opposite ends thereof, such that adjacent like mobile tables can be interconnected in a variety of different configurations.

14. A mobile table as set forth in claim 13, wherein:
said male latch member is movably mounted on said top to permit shifting said male latch member between a fully extended position and a fully retracted position to facilitate use of said mobile table in a stand-alone condition.

15. A mobile table as set forth in claim 1, including:
a utility post supported on the floor surface, and shaped to be received in the central space created by adjacently positioned like mobile tables.

16. A mobile table as set forth in claim 1, including:
a latch connected with said mobile table, and configured to detachably interconnected adjacent like mobile tables in a pull-apart fashion.

17. A mobile table as set forth in claim 16, wherein:
said latch is configured to selectively engage similar latches of adjacent like mobile tables even when the side edges of like mobile tables are manually converged along a line of motion which is not substantially perpendicular to said side edge.

18. A mobile table as set forth in claim 1, wherein:
said outer marginal edge and said inner marginal edge have a substantially identical shape such that said inner marginal edge matches the outer marginal edge of an adjacent like mobile table top.

19. A mobile table as set forth in claim 1, wherein:
said outer marginal edge and said inner marginal edge are contoured, and said side edges are flat and disposed substantially perpendicular to upper and lower surfaces of said top.

20. A mobile table as set forth in claim 1, wherein:
a fourth one of said legs has an upper end thereof connected with said top at a location disposed adjacent to said outer marginal edge intermediate said third and fourth legs, and a lower end with a vertically adjustable glide to abut the floor surface.

21. A mobile conference table system, comprising:
a plurality of mobile tables, each including:
a top having a pair of oppositely oriented, mutually tapered side edges configured to abut generally flush with similar side edges of adjacent ones of said mobile tables to create an enlarged substantially continuous open worksurface, an outer marginal edge configured to accommodate a user thereby, and an inner edge with a shape which defines a central space when aligned with similar inner marginal edges of adjacent ones of said mobile tables; said top side edges tapering inwardly toward each other from said outer marginal edge to said inner marginal edge; and
a plurality of legs connected with said top and depending therefrom to support each of said mobile tables on a floor surface in a freestanding fashion, wherein first and second ones of said legs have upper ends thereof connected with said top at locations disposed adjacent to said outer marginal edge at opposite sides thereof, and lower ends thereof with feet to abut the floor surface, and third and fourth ones of said legs have upper ends thereof connected with said top at locations disposed adjacent to said inner marginal edge at opposite sides thereof and lower ends thereof with rollers to permit manual translation of said mobile tables on the floor surface in wheelbarrow fashion, such that said mobile tables can be easily reconfigured by a single person to accommodate different groups and meeting activities.

22. A mobile table system as set forth in claim 21, including:
a utility post supported on the floor surface, and shaped to be received in the central space created by adjacently positioned ones of said mobile tables.

23. A mobile table system as set forth in claim 21, wherein:

each of said mobile tables includes a latch connected therewith, and configured to detachably interconnect adjacent ones of said mobile tables in a pull-apart fashion.

24. A mobile table system as set forth in claim 23, wherein:

said latch is configured to selectively engage similar latches of adjacent ones of said mobile tables even when the side edges of said mobile tables are manually converged along a line of motion which is not substantially perpendicular to said side edges.

25. A mobile table system as set forth in claim 21, wherein:

said outer marginal edge and said inner marginal edge of each of said mobile tables have a substantially identical shape such that said inner marginal edge matches said outer marginal edge of an adjacent one of said mobile tables.

26. A modular table system, comprising:

a plurality of individual modular tables, each including a top having at least one side edge thereof configured to abut generally flush with a similar side edge of an adjacent one of said modular tables to create an enlarged substantially continuous worksurface, and at least one leg connected with said top and depending therefrom to support said modular tables on a floor surface in a freestanding fashion;

a male latch member mounted on a first one of modular tables, and including a resilient arm configured to protrude outwardly of said side edge of said first modular table; said male latch member including an upwardly protruding barb portion thereof disposed adjacent a free end of said arm, and having a beveled outer edge;

a female latch member mounted on a second one of said modular tables, and including a catch edge shaped to engage the barb portion of said male latch member, and positioned to selectively retain the side edges of said first and second modular tables closely together when the same are positioned in an adjacent and aligned condition; said female latch member including a marginal edge portion, which is disposed outwardly of said catch edge adjacent the side edge of said second modular table, and is beveled to wedgingly mate with the beveled outer edge of said male latch member; said marginal edge extending uninterrupted between opposite sides of said catch edge, whereby the barb portion of said male latch member is abuttingly deflected over the beveled marginal edge of said female latch member and snaps into place against said catch edge, even when the side edges of said first and second modular tables are manually converged along a line of motion which is not substantially perpendicular to said side edges.

27. A modular table system as set forth in claim 26, wherein:

said barb portion of said male latch member includes an inner edge shaped to abuttingly deflect over and disengage said female latch member when said first and second modular tables are manually diverged.

28. A modular table system as set forth in claim 27, wherein:

said male latch member is movably mounted on said first modular table to permit shifting said male latch member between a fully extended position wherein said arm protrudes from the side edge of said first modular table, and a fully retracted position wherein said arm is positioned wholly under the top of said first modular table to facilitate use of said first modular table in a stand-alone condition.

29. A modular table system as set forth in claim 28, wherein:

said male latch member comprises a cam rotatably mounted on a lower surface of the top of said first modular table for rotation about a generally vertical axis between said fully extended position and said fully retracted position.

30. A modular table system as set forth in claim 29, wherein:

said leg of each of said modular tables includes a lower end thereof with means for permitting manual translation of said modular tables across the floor surface.

31. A modular table system as set forth in claim 30, wherein:

said top of each of said modular tables includes an inner edge with a generally concave shape which defines a central space when aligned with similar inner marginal edges of adjacent ones of said modular tables.

32. A modular table system as set forth in claim 31, wherein:

said top of each of said modular tables includes an outer marginal edge configured to accommodate a user thereby.

33. A modular table system as set forth in claim 32, wherein:

said at least one leg includes a first leg having an upper end thereof connected with said top at a location disposed adjacent to said outer marginal edge and a lower end thereof with a foot to abut the floor surface, and a second leg having an upper end thereof connected with said top at a location disposed adjacent to said inner marginal edge and a lower end thereof with a roller to define at least a portion of said table translation means, and thereby permit .manual translation of said mobile table across the floor surface in wheelbarrow fashion.

34. A modular table system as set forth in claim 33, wherein:

said roller comprises a caster pivotal about a generally vertical axis to facilitate translation of said modular tables in all directions.

35. A modular table system as set forth in claim 34, wherein:

said at least one leg includes a third leg having an upper end thereof connected with said top at a location disposed adjacent to said inner marginal edge, generally opposite said first leg, and a lower end thereof with a roller to permit manual translation of said modular tables across the floor surface in wheelbarrow fashion.

36. A mobile table system as set forth in claim 35, wherein:

said side edge of each of said modular tables includes one said male latch member and one said female latch member spaced equidistant from opposite ends thereof, such that said modular tables can be interconnected in a variety of different configurations.

37. A modular table system as set forth in claim 26, said male latch member is movably mounted on said first modular table to permit shifting said male latch member between a fully extended position wherein the same protrudes from the side edge of said first modular table, and a fully retracted position wherein the same is positioned wholly under the top of said first modular table to facilitate use of said first modular table in a stand-alone condition.

38. A modular table system as set forth in claim 26, wherein:

said male latch member comprises a cam rotatably mounted on a lower surface of the top of said first modular table for rotation about a generally vertical axis between a fully extended position and fully retracted position.

39. A modular table system as set forth in claim 26, wherein:

said leg of each of said modular tables includes a lower end thereof with means for permitting manual translation of said modular tables across the floor surface.

40. A modular table system as set forth in claim 26, wherein:

said top of each of said modular tables includes an inner edge with a generally concave shape which defines a central space when aligned with similar inner marginal edges of adjacent ones of said modular tables.

41. A modular table system as set forth in claim 26, wherein:

said at least one leg includes a first leg having an upper end thereof connected with said top at a location disposed adjacent to said outer marginal edge and a lower end thereof with a foot to abut the floor surface, and a second leg having an upper end thereof connected with said top at a location disposed adjacent to said inner marginal edge and a lower end thereof with a roller to define at least a portion of said table translation means, and thereby permit manual translation of said mobile table across the floor surface in wheelbarrow fashion.

42. A modular table, comprising:

a top having at least one side edge thereof configured to abut generally flush with a similar side edge of an adjacent one of said modular tables to create an enlarged substantially continuous worksurface, and at least one leg connected with said top and depending therefrom to support said modular table on a floor surface in a freestanding fashion;

a male latch member mounted on said top adjacent one end of said side edge, and including a resilient arm configured to protrude outwardly of said side edge; said male latch member including an upwardly protruding barb portion thereof disposed adjacent a free end of said arm, and having a beveled outer edge;

a female latch member mounted on said top adjacent an opposite end of said side edge, and including a catch edge shaped to engage the barb portion of an adjacent male latch member, and positioned to selectively retain the side edges of adjacent modular tables closely together when the same are positioned in an adjacent and aligned condition and wherein said female latch member includes a beveled marginal edge portion, which is disposed outwardly of said catch edge adjacent said side edge, whereby the barb portion of said male latch member is abuttingly deflected over the beveled marginal edge of said female latch member and snaps into place against said catch edge, even when the side edges adjacent modular tables are manually converged along a line of motion which is not substantially perpendicular to said side edges.

43. A modular table system as set forth in claim 42, wherein:

said barb portion of said male latch member includes an inner edge shaped to abuttingly deflect over and disengage said female latch member when adjacent modular tables are manually diverged.

44. A modular table system as set forth in claim 43, wherein:

said male latch member is movably mounted on said top to permit shifting said male latch member between a fully extended position wherein said arm protrudes from said side edge, and a fully retracted position wherein said arm is positioned wholly under said top to facilitate use of said modular table in a stand-alone condition.

* * * * *